US005425423A

United States Patent [19]

Dobson et al.

[11] Patent Number: 5,425,423

[45] Date of Patent: Jun. 20, 1995

[54] WELL COMPLETION TOOL AND PROCESS

[75] Inventors: Richard M. Dobson; Jefferey D. Herndon; Leo D. Hudson, all of Bakersfield, Calif.

[73] Assignee: Bestline Liner Systems, Bakersfield, Calif.

[21] Appl. No.: 215,920

[22] Filed: Mar. 22, 1994

[51] Int. Cl.[6] ..... F21B 43/04

[52] U.S. Cl. ..... 166/278; 166/51; 166/123; 166/318

[58] Field of Search ..... 166/278, 318, 51, 123, 166/181, 182, 387

[56] References Cited

U.S. PATENT DOCUMENTS

| | | | |
|---|---|---|---|
| 4,253,522 | 3/1981 | Setterberg, Jr. | 166/51 X |
| 4,365,671 | 12/1981 | Long | 166/318 |
| 4,410,158 | 8/1983 | Spencer et al. | 166/51 |
| 4,606,408 | 8/1986 | Zunkel et al. | 166/51 X |
| 4,726,419 | 2/1988 | Zunkel | 166/278 X |
| 5,253,708 | 10/1993 | Alexander | 166/278 |
| 5,255,741 | 10/1993 | Alexander | 166/278 |
| 5,332,038 | 7/1994 | Tapp et al. | 166/278 |
| 5,343,949 | 9/1994 | Ross et al. | 166/278 |

*Primary Examiner*—Ramon S. Britts
*Assistant Examiner*—Frank S. Tsay
*Attorney, Agent, or Firm*—Lyon & Lyon

[57] ABSTRACT

An oil well tool including a release mechanism, a splined torque transmitting driver, a liner, an under reamer and a drill bit. Circulation in a passageway through the tool provides drilling foam or fluid to the drill bit and under reamer. A restriction below the under reamer provides pressure to hydraulically force cone arms of the under reamer outwardly. A valve mechanism located within a stinger subassembly within the liner controls communication between the central passageway and the perforated liner. The valve is actuated by placement of a ball following drilling. Gravel packing through the well annulus may then occur following drilling. A second valve may later by actuated to separate the drill pipe from the liner and associated components.

14 Claims, 7 Drawing Sheets

10
11
12
14
24
26
28
32
34
36
38
40
42
44
46
48
50
52
54
58
60
62
64
68
70
72
76
91

17
96
98
102
100
104
88
90
78
80
89
84
82
86
18
108
112
20
118
22

10
11
12
3
54
268
64
3

200
202
204
206
208
210
212
214
216
16
218
220
222
224
226
230
232
234
236
238
240
242
244
246
248
250
252
254
256
258
260
262
264
4
4

WELL COMPLETION TOOL AND PROCESS

BACKGROUND OF THE INVENTION

The field of the present invention is oil well completion tools and techniques.

It is frequently advantageous to complete a well, either original, reopened or refurbished, by placing a perforated liner at the oil bearing strata surrounded by a gravel pack. Such a completion may necessitate drilling the well bore and/or undercutting the strata, removing the cuttings, placing a liner and sealing the liner to the adjacent casing. Performing these several steps independently can be time consuming and expensive.

A tool including a drill and a perforated liner has been devised whereby a well may be completed at least in preparation for the placement of a sand control adapter with a single equipment insertion. A drill bit and liner are axially associated. A fluid circulation passage extends through the assembly and may be controlled by a valve mechanism in the liner able to divert flow from the drill bit to a lateral flow through the liner. Axial splines associated between a drill pipe section and the well liner assembly along with a release mechanism to axially release the drill pipe section from the liner assembly provides for drilling with a liner in place. An under reamer is associated with the drill bit and liner assembly with the under reamer actuated by the circulation to the drill bit.

A device for sealing the end of a perforated liner to a well casing following the drilling, liner placement, cutting removal and gravel pack may be performed by a sand control adapter such as disclosed in U.S. Pat. No. 5,052,483, the disclosure of which is incorporated herein by reference.

With such an assembly, a single zone may be finished. However, in many wells, multiple productive zones may be present with interleaved nonproductive zones, water zones, desaturated zones and the like. A particular difficulty in refurbishing and reopening is the presence of desaturated zones which can rob production. Such zones can also interfere with tertiary recovery, uselessly absorbing steam. Special techniques are frequently required, such as cementing the section or covering with inner liners, for such zones.

SUMMARY OF THE INVENTION

The present invention is directed to a well completion tool for and the process of addressing the completion of multiple zones with a single installation.

In a first, separate aspect of the present invention, a liner section for association with a completion system provides access through the wall of the liner section. A slide valve is positioned in the liner section and movable between two positions. The liner section is actuated by two pistons which have a seal therebetween. This arrangement provides for a required high initial pressure to initiate opening of the valve and a lower pressure for maintaining the valve in an open position. Ports controlled by the valve provide for direction of circulation through the wall of the liner section for the treatment of a section of the well. Such a device is of particular utility for cementing a well.

In a second, separate aspect of the present invention, the aforementioned liner section may be associated with tubing extending therethrough. The tubing has a valve for controlling circulation through the tubing wall to the liner section. Seals close the annular passage between the tubing and the liner section at each end of the liner section for separate treatment of the well section adjacent the liner section.

In a third, separate aspect of the present invention, at least two perforated liner sections axially aligned contain a tube extending therethrough. The liner sections are separated by a seal with valves controlling circulation through the wall of the tube at each liner section. Individual treatment of separate sections of a well with one placement of a tool may be accomplished.

In a fourth, separate aspect of the present invention, a process of cementing a well includes isolating a liner section which has controlled perforations through the wall thereof and an axially extending tube extending therethrough. Radial passageways in the tube wall are opened and the controlled perforations in the liner section are opened to circulate cement from the tube, through the perforations to cement a well section.

In a fifth, separate aspect of the present invention, two or more zones in a well may be treated by positioning at least two liner sections axially aligned with perforations therethrough in the zones. The liner sections are sealed one from another. The lowermost zone is treated by opening circulation with tubing extending into the lower liner section. Circulation with the lower section is then cut off once that section is completed and a next section is treated. The separate zones may be gravel packed, cemented or the like. When cementing a zone, circulation through the liner section perforations may be controlled by valving.

Accordingly, it is an object of the present invention to provide improved well completion apparatus and processes. Other and further objects and advantages will appear hereinafter.

DETAILED DESCRIPTION OF THE PREFERRED EMBODIMENT

Figures 1, 1A, 1B, 1C:
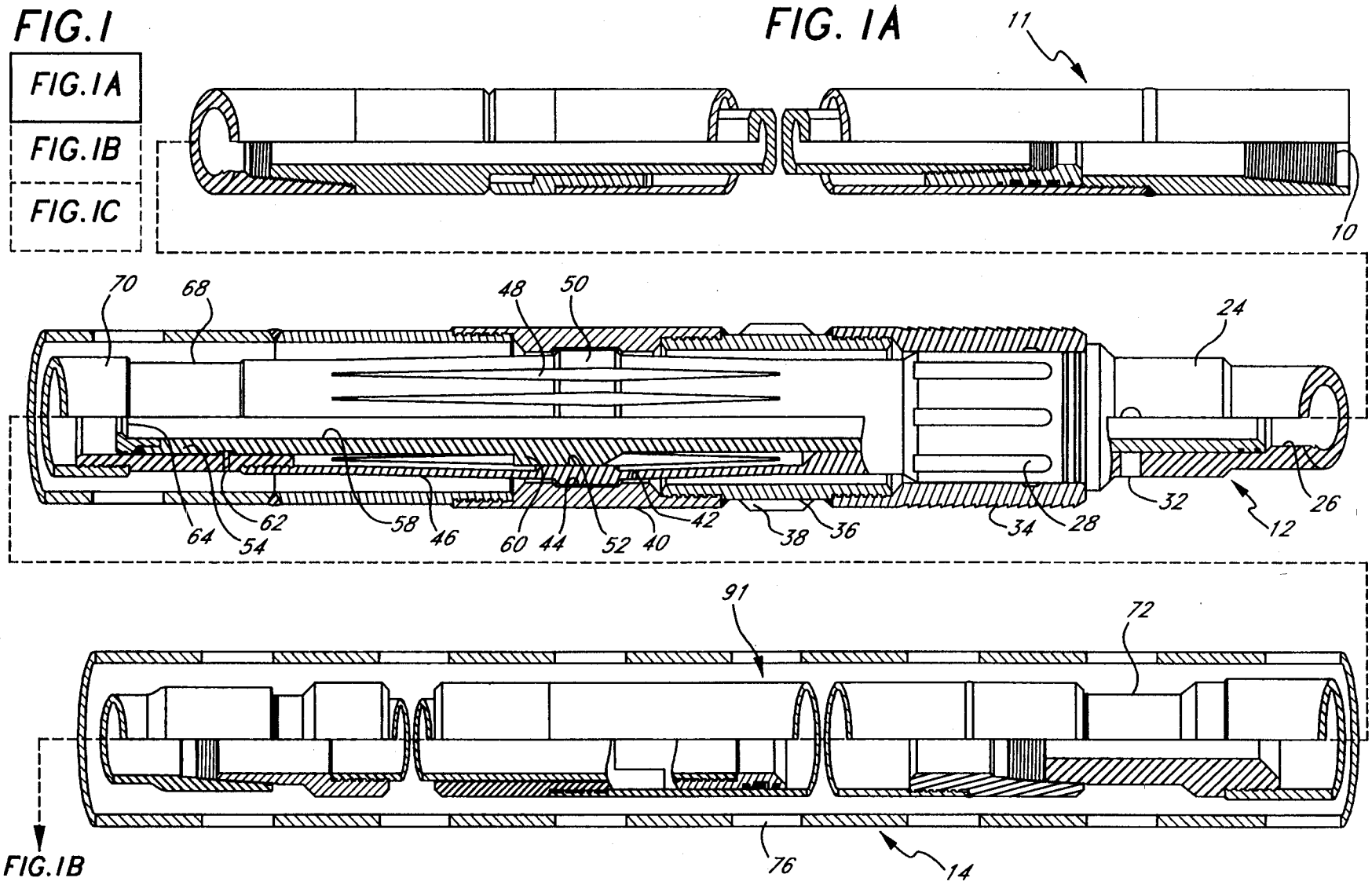
FIG. 1 is a cross-sectional view of a well tool having first and second perforated liners.
Figure 1B:
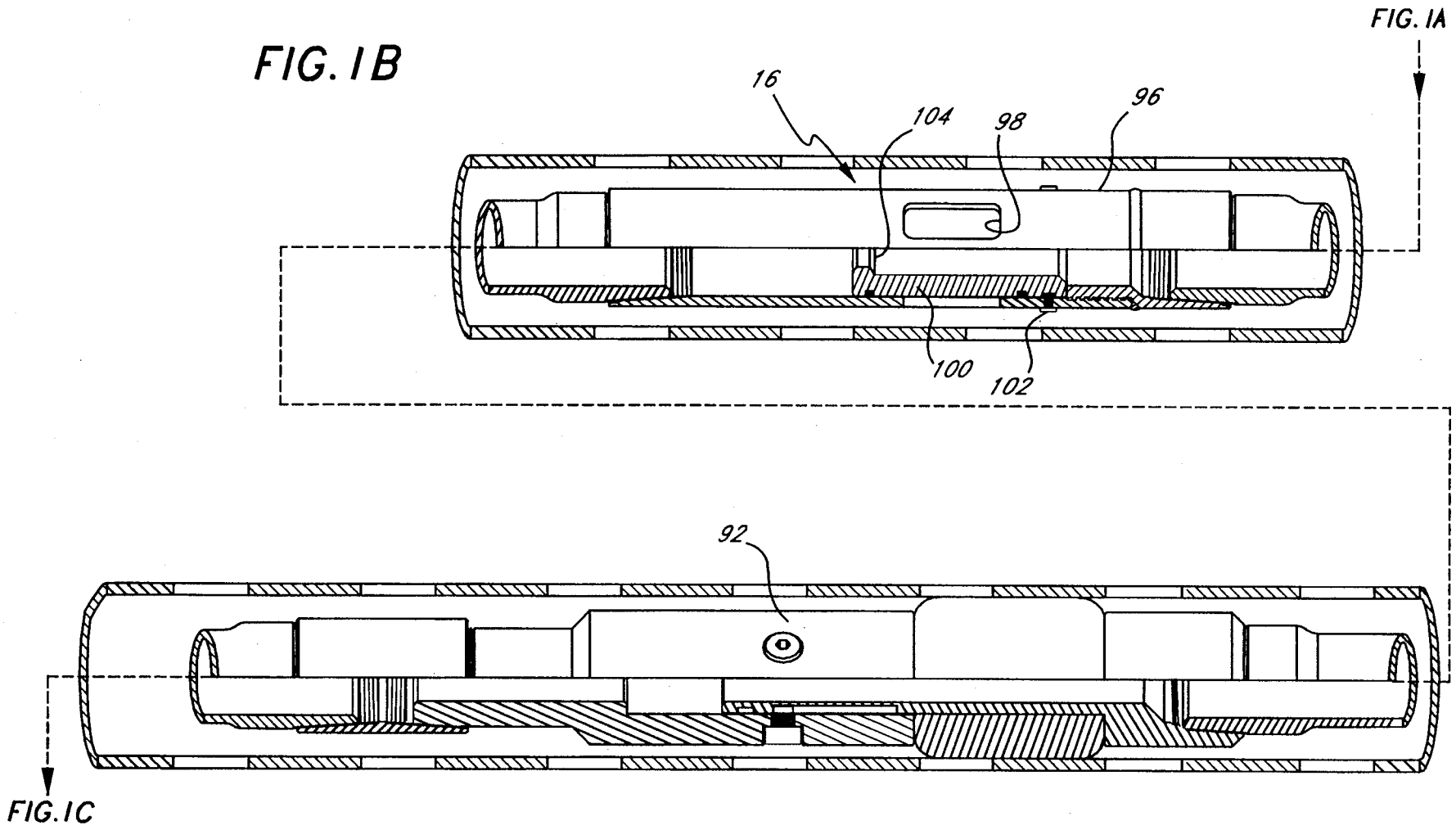
Figures 1B, 1C:
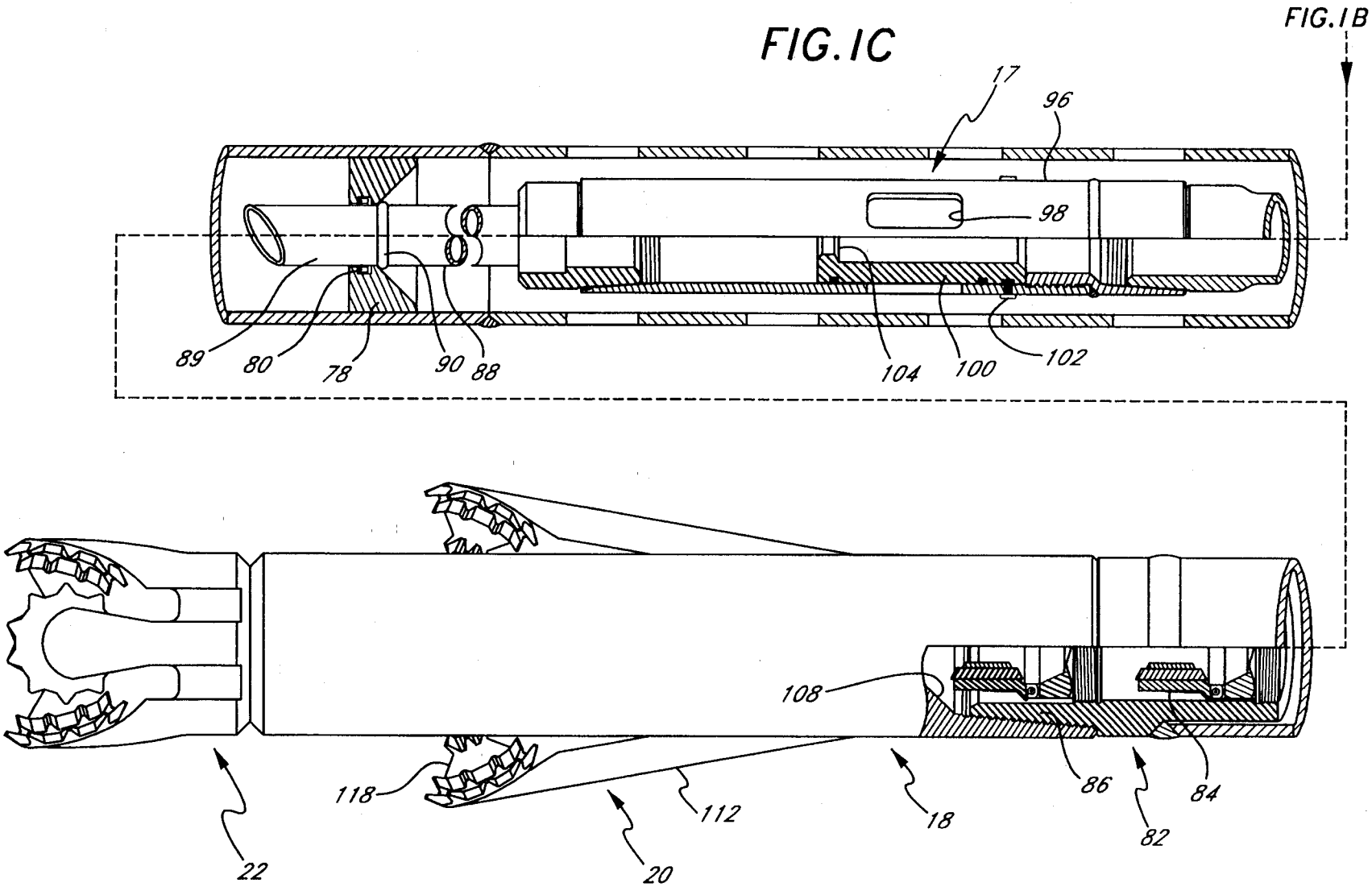

Turning in detail to the drawings, a completion tool is illustrated in FIG. 1 which has two sections of perforated liner. The device illustrated is to be positioned down a well through an outer casing (not shown) and attached to a drill pipe (not shown). The condition of the device as shown in FIG. 1 but for the lateral extension of the cone arms is the condition in which the tool is lowered through the casing to the appropriate position in the well. Internal threads 10 at one end of the assembly are coupled to the end of the drill pipe. The tool is lowered into the well without circulation.

Looking to the principal components, generally designated are a bumper subassembly 11, a release mechanism 12, a liner assembly 14, circulating valves 16 and 17 and a drill 18 including an under reamer 20 and a drill bit 22. The release mechanism 12 functions in this embodiment to attach to the drill pipe by internal threads 10, to transmit torque from the drill pipe through to lower components, to provide circulation axially through the component and to selectively release certain lower components from the drill pipe.

A driver 24 includes the internal threads 10 associated with the drill pipe. A central bore 26 provides for communication axially through the driver 24. Splines 28 extend axially at one end of the driver 24. Holes 32 extending laterally from the central bore 26 provide for selective circulation of drilling foam and/or fluid.

Outwardly of the splines 28 is an internally splined collar 34. The internally splined collar 34 cooperates with the splines 28 of the driver 24 to transmit axial torque imposed by the drill pipe. When released, the internally splined collar 34 will axially disengage the driver 24. Permanently affixed to the end of the collar 34 is a centralizer 36. The centralizer 36 includes a central bore and uniformly outwardly extending elements 38 about its periphery. Attached permanently to the centralizer 36 is a profile element 40. The profile element 40 includes a central bore 42 having an annular channel 44 with tapered ends. The profile element 40 forms the outer element of the release device.

Axially coupled to the driver 24 is a tube 46 which is axially split along its central portion. These splits 48 provide for resilient radial expansion of the tube 46. At a midpoint of the axial splits 48, the tube 46 includes an outwardly annular boss 50 and an inwardly annular boss 52. When the tube 46 is forced outwardly at the splits 48, the outwardly annular boss 50 engages the annular channel 44. This axial interlocking between the outwardly annular boss 50 and the annular channel 44 interlocks the tube 46 with the profile element 40. In turn, this interlocking joins the internally splined collar 34 with the driver 24 and in turn the drill pipe.

Located inwardly of the tube 46 is a piston 54 sealed to the tube 46 by O-rings at either end. The piston 54 is a cylindrical tube having a circulation bore 58 therethrough. The piston also includes an annular boss 60 about its periphery. The boss 60 is positioned on the piston 54 such that it is positioned against the inwardly annular boss 52 at one end of the piston stroke. The boss 60 is of sufficient diameter that the tube 46 is expanded outwardly at the splits 48 with the boss in this position. When the piston 54 is moved from this position, the boss 60 fits within the circular bore 58 of the piston 54 without forcing the wall of the tube 46 outwardly.

At one end of its stroke with the annular boss 60 against the inwardly annular boss 52, the body of the piston 54 covers over the radially extending holes 32, preventing circulation from the interior bore of the driver 24 outwardly through these holes 32. Also with the piston 54 in this position, three brass sheer pins 62 retain the piston 54 from moving axially through the tube 46.

At the down hole end of the piston 54 there is a valve seat 64. Received within the ball valve seat 64 at an appropriate time is a valve element or ball (not shown). The ball is dropped down the drill pipe during circulation of foam downwardly through the pipe. The ball comes to rest in the valve seat 64 shutting off circulation at that point. This causes an overpressure within the piston 54 and against the ball. With this overpressure, the pins 62 are sheered and the piston 54 moves downwardly a sufficient distance so that the annular boss 60 disengages the inwardly annular boss 52 and uncovers the radially extending holes 32.

The annular boss 60 is shown to engage a shoulder of a cylinder 68 threaded into the lower end of the tube 46 and containing the sheer pins 62. Below the cylinder 68 is a tube 70 terminating in a pin 72. The tube 70 and pin 72 include a central bore through which circulation may pass prior to location of the ball in the valve seat 64. The tube 70 provides a cavity for the run out of the piston 54.

The liner assembly 14 in this embodiment is a slotted liner 74 having a peripheral wall and perforations therethrough. Where advantageous, blank liner segments may also be used. The liner assembly 14 is associated with the internally splined collar 34, the centralizer 36 and the profile element 40. With disengagement in the release device, the components associated with the liner assembly 14 are axially released from the driver 24 and in turn the drill pipe. This allows the drill pipe to be separated from the liner assembly and removed from the well.

The liner assembly 14 terminates at its lower end in a pack-off sleeve 78 defined by an internal flange with an O-ring 80 seated therein. The pack-off sleeve 78 is located below any perforations through the liner assembly wall. The pack-off sleeve is also associated with a seal subassembly 82 having one-way flapper valves 84 mounted therein. The seal 82 terminates in a threaded pin 86 for association with the drill 18.

Prior to the release of the release mechanism 12, the liner assembly 14, between its attachment to the profile element 40 and the pack-off sleeve 78, contains the lower end of the split tube 46, the axially associated cylinder 68, the tube 70, the pin 72 and a stinger subassembly 88. The stinger subassembly 88 terminates in a stinger 89 which extends through the pack-off sleeve 78. Between the stinger subassembly 88 and the liner assembly 14, there is an annular space. The annular space extends from the pack-off sleeve 78 to the release mechanism 12. An annular seal 90 cooperates with the pack-off sleeve to seal the lower end of the liner assembly 14. With this assembly, circulation between the drill pipe and the end of the stinger may be selectively isolated from the liner.

The circulating valves 16 and 17 form part of the stinger subassembly 88 along with a conventional tubing expansion joint 91 and a seal defined by a conventional retrievable packer 92. The retrievable packer 92 divides the annular space between the stinger subassembly 88 and the liner assembly 14, effectively dividing the liner 74 into two sections. The stinger subassembly 88 is associated at one end with the pin 72 and at the other end with the stinger 89. Each of the circulating valves 16 and 17 have a valve body 96 in the form of tubing. The tube 96 includes radial holes 98 therethrough forming passages between the interior of the valve body 96 and the liner assembly 14. A valve element in the form of a piston 100 is positioned within the valve body 96 to selectively close the radial holes 98.

FIG. 1 illustrates both valves 16 and 17 in the closed position with the valve pistons 100 located over the radial holes 98. In this position, brass sheer pins 102 retain the piston in place. O-rings about the periphery of the piston 100 seal the valve elements.

The valve pistons 100 has seats 104 into which valve elements in the form of appropriately sized balls (not shown) may be placed. The balls may be positioned by introduction into the drill pipe with circulation of foam or fluid downwardly through the drill pipe. The balls then would come to rest in the appropriate seat 104 closing off circulation through the interior of the valve piston 100. As with the release device, the overpressure created by closure of the passage through the valve seat 104 sheers the pins 102 and causes the piston 100 to move through its stroke. This exposes the radial holes 98 allowing circulation between the interior of the drill pipe and the liner assembly 14. The seats 104 and the balls associated with each must be of different diameter with the lower seat 104 and associated ball being smaller. This allows the first ball in to pass through the upper circulating valve 16 and become seated in the lower valve 17.

Associated with the pin 86 is the drill 18. The drill 18 includes the under reamer 20 having a central passage 108. Mounted about pivotal couplings 110 are cone arms 112. The cone arms 112 include drilling cones 118 for under reaming a cavity with rotation of the drill 18. The body of the under reamer 20 includes lateral cavities in communication with the central passage 108. Positioned within the lateral cavities are pistons on the cone arms 112. Below the lateral cavities, the passage is restricted. Two thinner passages extend axially and about the seat area for the cone arms 112 and drilling cones 118. The reductions at the restricted portions in the axial passage 108 create back pressure operating against the pistons to force the cone arms 112 outwardly for the drilling operation.

Before the placement of the balls, the various passages through the components provide an overall axial passageway through the entire tool to the drill bit 22. The drill bit 22 is located axially at the end of the under reamer 20 and may be conventional in construction and small enough to fit through the well casing.

Turning to application of the tool, with the cone arms 112 collapsed and circulation through the drill pipe off, the tool may be inserted through the well casing to the appropriate location for well completion. Upon positioning of the tool, circulation is established. This results in drilling foam passing through the drill pipe and the tool to the under reamer 20 and the drill bit 22. No drilling foam passes directly from the drill pipe to the liner assembly 14 without first passing through the under reamer 20 and the drill bit 22. Because of the torsional coupling provided by the splines 28 of the driver 24 and the splines of the spline collar 34, rotation of the drill pipe will result in operation of the drill bit 22 and the under reamer 20. Because of the circulation, the cone arms 112 are spread during this operation to create a cavity. The circulation through the drill pipe carries cuttings from the drilling operation upwardly through the annulus between the drill pipe and the casing. This flow would be substantially outwardly of the liner assembly 14 except for that which may pass through the slits 76.

Once a first well section has been expanded by the under reamer 20, circulation is stopped. This removes the pressure from the drill 18 and allows the cone arms 112 to collapse. The tool can then be lowered and further drilling undertaken to form a second expanded well section. Additional such sections also are possible. A corresponding number of additional circulating valves and retrievable packers could be used.

When the drilling is complete, the smallest ball is dropped into the well in the drill pipe. It passes with the circulation down to the valve seat 104 of the lower circulating valve 17. As the ball seats, an overpressure is experienced which causes the piston 100 to axially stroke downwardly to expose the radial holes 98. With this actuation of the circulating valve 17, circulation is routed down the drill pipe, through the radial holes 98 to the liner assembly 14 and outwardly through the perforations 76. Circulation cannot reverse through the drill bit 22 because of the one-way flapper valves 84. Circulation cannot extend upwardly within the liner assembly 14 because of the retrievable packer 92. The continued circulation through the perforations 76 clears the liner assembly 14 of all cuttings.

After the flow is clear, circulation is reversed to proceed down the well annulus, through the perforations 76 and returned through the drill pipe. With the upper circulating valve 16 closed, the upper liner section may fill but no circulation is experienced. Gravel is then introduced for the purpose of packing the cavity cut by the under reamer 20. When the gravel has appropriately filled the cavity, circulation is substantially reduced because of the interference of the gravel outwardly of the liner.

Once the cavity is appropriately filled with gravel, circulation is again reversed and the next sized ball is placed into the drill pipe. The ball is driven by the circulation down to the valve seat 104 in the upper gravel pack valve 16. The same process is then repeated to gravel pack the upper well section which has been expanded by under reaming for this purpose.

A largest ball is then placed in the circulation down the drill pipe to the valve seat 64 associated with the piston 54 to cause the piston 54 to axially stroke because of the overpressure on the ball. The ball terminates circulation through the center of the release mechanism 12. However, movement of the piston 54 downwardly uncovers the radial holes 32 to allow some continued circulation into the well annulus. With the axial stroke of the piston 54, the release device releases the liner and associated components from the drill pipe and driver 24. The driver 24, the split tube 46, the circulating valves 16 and 17 and the stinger 89 may be retracted from the well. This leaves the liner assembly 14 in place as well as the drill 18. A suitable sand control adapter may be positioned atop the liner to cooperate with the surrounding casing. The well may then be completed in traditional fashion.

Figures 2, 2A, 2B, 2C:
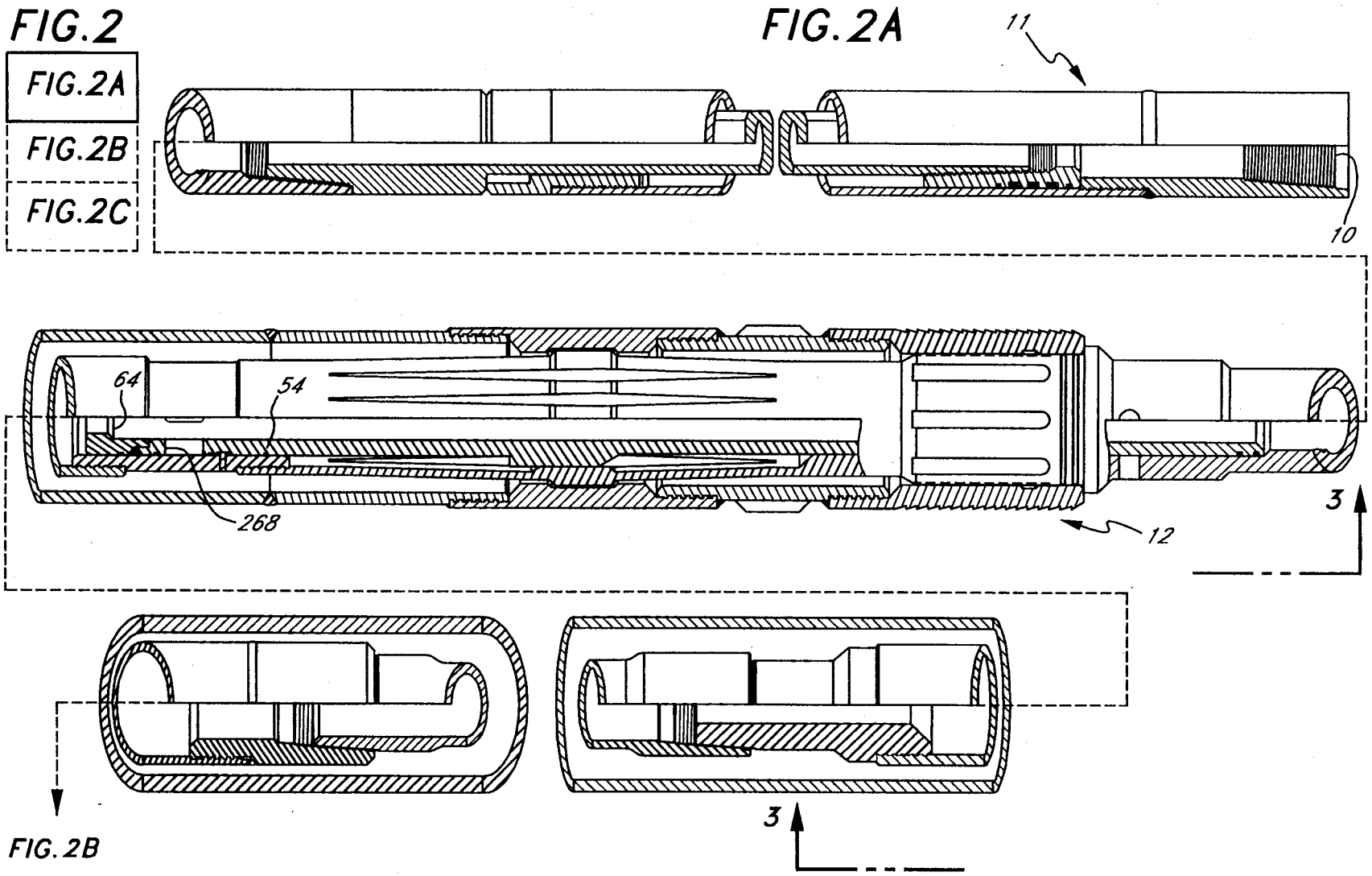
FIG. 2 is a cross-sectional view of a well tool having a first perforated liner and a second, valve controlled perforated liner.
Figures 2A, 2B, 2C:
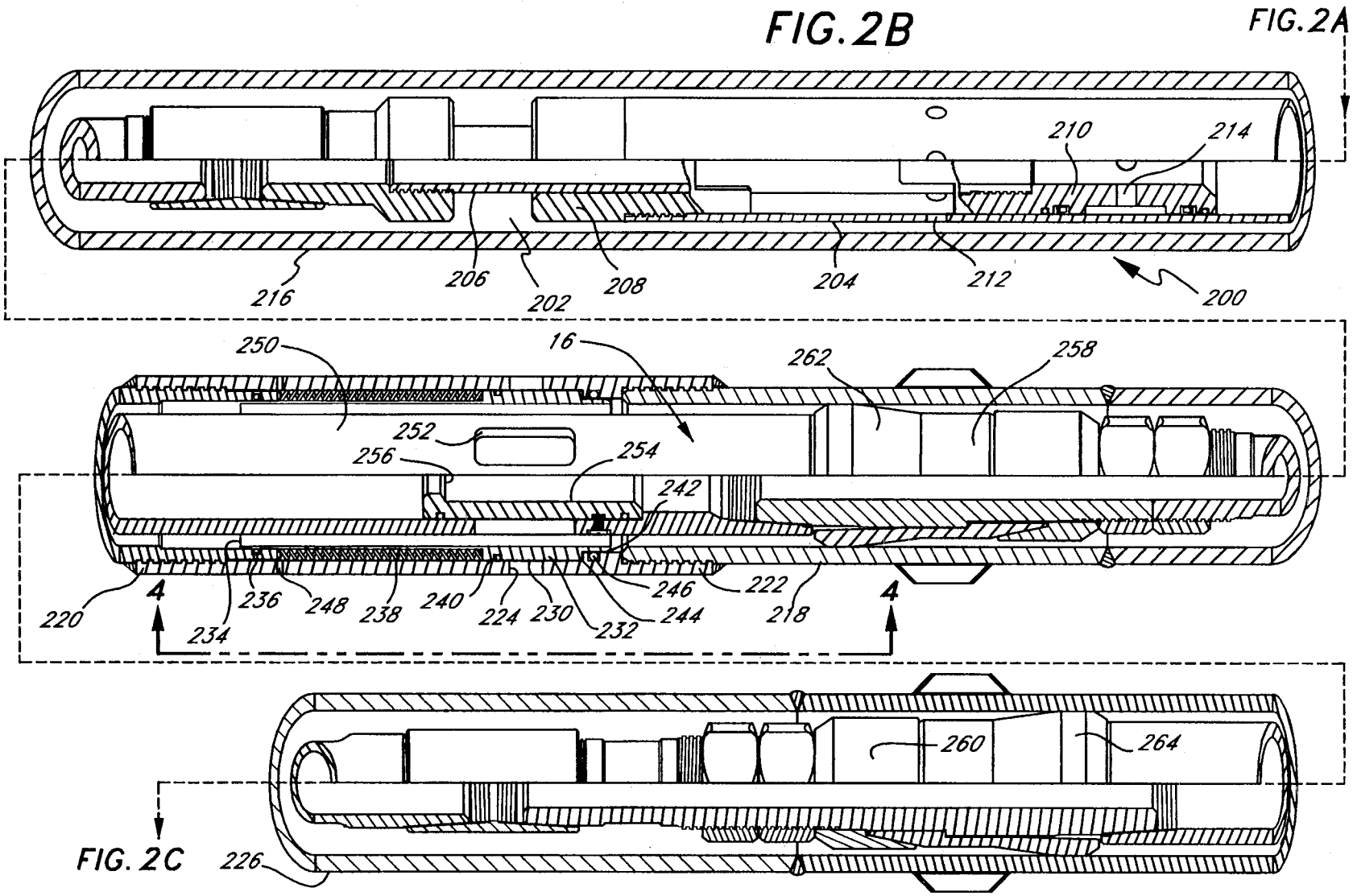
Figure 2C:
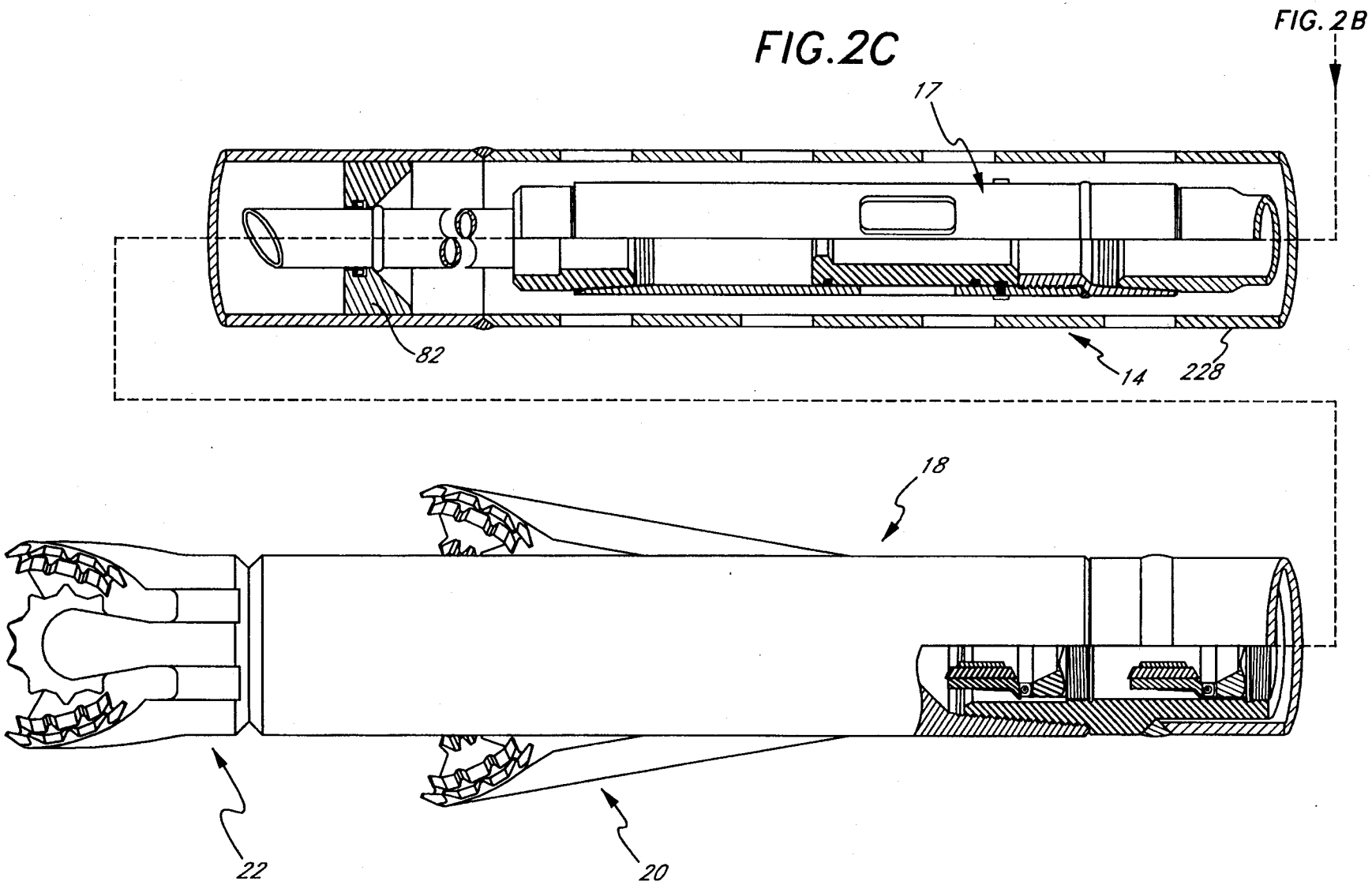
Figure 3A:
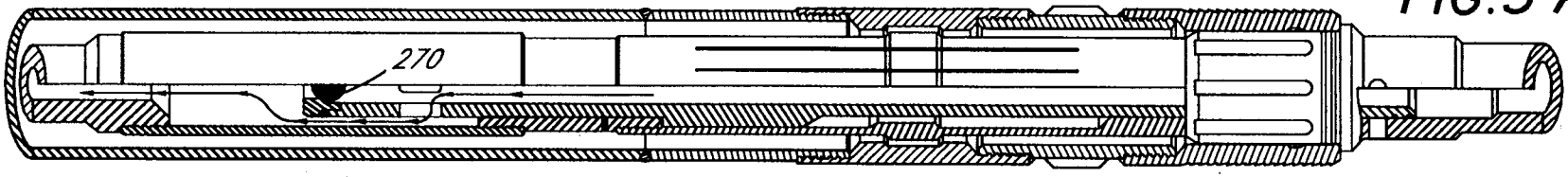
FIG. 3 is a detail view of portion 3—3 of FIG. 2 with the mechanism released in FIG. 3A and engaged in FIG. 3B.
Figure 3B:
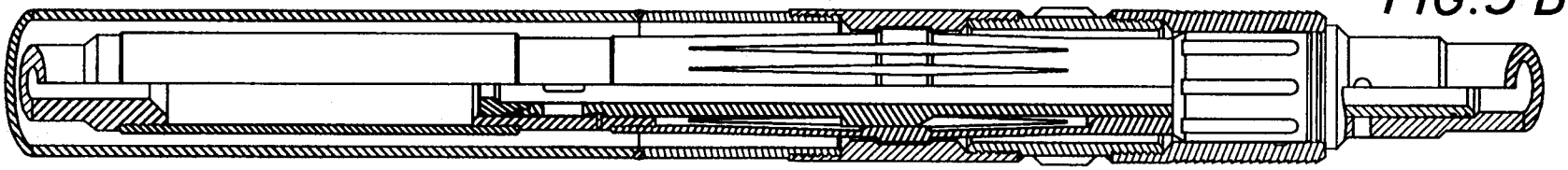
Figure 4:
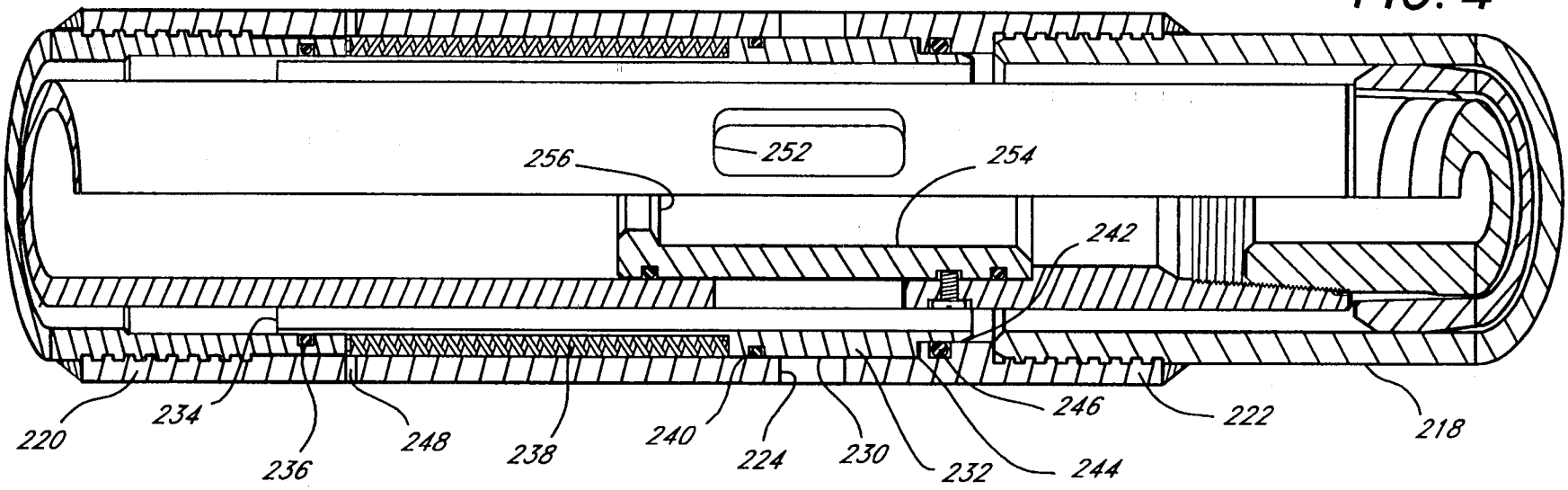
FIG. 4 is a detail view of portion 4—4 of FIG. 2.

Another completion tool is illustrated in FIGS. 2 through 4 having two sections of perforated liner, one of which provides a valve to cover the perforations. As with the embodiment of FIG. 1, the device is to be attached to a drill pipe and positioned down a well. A significant portion of this tool is similar to that of the device of FIG. 1. A bumper subassembly 11, a release mechanism 12, circulating valves 16 and 17, a perforated liner section 14 associated with the circulating valve 17 and a drill 18 including an under reamer 20 and a drill bit 22 are similarly constituted and the foregoing disclosure is referenced as to these components. Similar reference numbers denote similar elements in FIGS. 1 and 2.

In FIG. 2, a tubing expansion joint with dump ports, generally designated 200 are additionally provided in a stinger subassembly, generally designated 202. The tubing expansion joint 200 is fixed at either end to tubing components in the stinger subassembly. The expansion joint 200 has an outer cylinder 204 and an inner cylinder 206. The cylinders 204 and 206 are telescoped together and include annular stops 208 and 210 associated with the cylinders 204 and 206, respectively. The outer cylinder 204 includes dump ports 212 which are sealed behind the inner cylinder 206. Once the release mechanism 12 is unlocked by placing a ball into the circulation to actuate the piston 54, the drill string can be lifted. This causes the outer cylinder to move upwardly until such time as the annular stops 208 and 210 engage. At this point, inner ports 214 in the annular stop 210 come into alignment with the dump ports 212. This provides for relief of pressure from the inside of the stinger subassembly 202.

Part of the liner assembly in the embodiment of FIG. 2 includes a blank liner section 216. This blank liner section 216 extends from the release mechanism 12 to around the tubing expansion joint 200. The liner assembly further includes a perforated liner section with controlled perforations. This liner section is specifically defined by two blank liner elements 218 and 220 threadably attached to either end of a cementing port collar 222. Radial perforations through the cementing port collar 222 define cementing ports 224. A further blank liner section 226 extends downwardly from the blank liner element 220 until a productive zone is encountered. Through the productive zone, a slotted liner section 228 extends coaxially with the stinger subassembly to the seal subassembly 82.

An annular slide valve 230 is positioned on the inner side of the cementing port collar 222. The slide valve includes a thick piston section 232 and a thin skirt section 234. The thin skirt section 234 extends to inwardly of the lower blank liner element 220 and is slidably sealed with the element 220 by means of an O-ring 236. The travel of the annular slide valve 230 is such that the seal at the O-ring 236 is always maintained. The skirt section 234 is separated inwardly from the cementing port collar 222 in order to provide room for compression springs 238. The piston section 232 includes an O-ring seal 240 which slides along the inner surface of the cementing port collar 222. The O-ring 240, along with the O-ring 236, seals off the volume which receives the compression springs 238 from the interior of the liner assembly.

At the end of the piston section 232 are two piston surfaces 242 and 244. The inner piston surface 242 presents a surface area which is greater than the end of the skirt section 234. Thus, when pressure is developed within the liner assembly, the slide valve 230 will move under the influence of the differential force applied at either end. The valve 230 moves from the position as shown in FIG. 2 with the cementing ports 224 closed so as to open the cementing ports 224. An O-ring pressure seal 246 in the cementing port collar 222 is presented between the two piston surfaces 242 and 244 to seal about the inner piston surface 242. Under high pressure, once the slide valve 230 moves downwardly such that the end has passed the O-ring pressure seal 246, pressure within the liner assembly will additionally present force on the outer piston surface 244. With the additional piston area, reduced or equal pressure can then complete the stroke of the slide valve 230 and retain the slide valve 230 in an open position. With the slide valve 230 moved fully to a lower position in the cementing port collar 222, the cementing ports 224 are open to pass material radially through the liner assembly. Bleed ports 248 relieve the annular chamber retaining the springs 238 as the slide valve 230 opens or closes.

Inwardly of the cementing port collar 222 and blank liner elements 218 and 220, a circulating valve 250 is arranged in the tubing and includes control valve passages 252. A sleeve piston 254 with a seat 256 for receiving a ball dropped into the circulation through the drill pipe actuates the circulating valve 250 so as to expose the control valve passages 252.

To either end of the circulating valve 250 are cup tools 258 and 260 employing a rubber cup 262 and 264, respectively. These rubber cups 262 and 264 define seals in the annular space between the tubing of the circulating valve 250 and the cementing port collar 222 to axially seal this annular space.

The release mechanism 12 is much like that of the first embodiment. However, flow from the drill pipe through the release mechanism is desired with the mechanism released but not fully removed. Flow ports 268 are presented at the lower end of the piston 54 above the valve seat 64. With the piston 54 in the upper position and the passage therethrough open, flow proceeds axially. When a ball 270 as seen in FIG. 3 is dropped to the valve seat 64, the piston 54 moves downwardly to disengage the boss 60 from the boss 52. As that disengagement is being completed, the flow ports 268 open, restoring circulation. The flow proceeds around the closure at the valve seat 64 and the end of the piston 54 to return to the central passage.

To employ the tool of FIG. 2, the assembly is lowered into a well with the under reamer 20 collapsed. Once positioned at a point where the under reamer 20 is to expand the well section, circulation is established through the drill pipe. The tool is rotated and an under reaming process is carried out. As noted above with the other embodiment, multiple such under reaming sections may be prepared depending on the number of productive zones and corresponding liner mechanisms. Once positioned fully down in the well, a first ball is dropped into the circulation. This ball is sized to fall through the seats 64 and 256. The ball seats in the piston 100 to open the circulating valve 17. Once the circulation is clear of chips, flow is reversed and gravel is dispensed to the under reamed section outwardly of the liner.

Once the gravel packing is completed, circulation is established down the drill pipe again and a second ball is introduced which passes through the piston 54 and comes to rest on the seat 256 of the piston 254. This opens the circulating valve 250 to expose the controlled valve passages 252. Once the controlled valve passages 252 are opened, pressure is presented to the annular space outwardly of the tubing between the rubber cups 262 and 264. Sufficient overpressure can be presented to initiate opening of the slide valve 230. As noted above, once the annular slide valve 230 is partially open, the second piston surface 244 is exposed to allow easy driving of the slide valve 230 to its fully opened position. At this point, the cementing ports 224 are open.

Once the cementing ports 224 are open, a last ball 270 is dropped which seats at the seat 64 of the piston 54. This releases the release mechanism 12. The release mechanism 12 is not withdrawn. An appropriate volume of cement is then circulated down the drill pipe to cement the well section about the cementing collar and blank liner area. Circulation continues down the drill pipe, through the flow ports 168, to the dump ports 212 and to the annular space. The drill pipe and release mechanism 12 are then lifted. This opens the dump ports 212. In turn, the pressure is released, allowing the slide valve 230 to close. Flow upwardly through the annular space can occur to remove excess cement. The cup tools 258 and 260 also wipe the liner during removal.

Accordingly, improved completion tools and techniques of completing an oil well are provided. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A well tool comprising:

a liner section including a peripheral wall with perforations radially through said peripheral wall;

a slide valve, said slide valve being movable in said liner section from a first position with said perforations covered to a second position with said perforations uncovered, said slide valve including a first annular piston surface facing in a first axial direction of said liner section and a second annular piston surface facing in said first axial direction, said second piston surface being outwardly of said first piston surface;

a spring operatively between said liner and said slide valve, said spring biasing said slide valve toward said first position;

a seal between said first piston surface and said second piston surface and between said liner and said slide valve when said slide valve is in said first position and separated from between said first piston surface and said second piston surface when said slide valve is displaced from said first position toward said second position.

2. The well tool of claim 1, said slide valve further including a skirt section terminating at said first piston surface, said seal being annular and mounted on said liner section against said skirt section when said slide valve is in said first position, said skirt section being separated from said seal with said slide valve in said second position.

3. The well tool of claim 1 further comprising:

a chamber defined between said slide valve and said liner section and said liner section further including a bleed port radially through said peripheral wall and extending to said chamber with said slide valve in both of said first and said second positions.

4. A well tool comprising:

a first liner section including a peripheral wall with first perforations radially through said peripheral wall;

a slide valve, said slide valve being movable in said first liner section from a first position with said first perforations covered to a second position with said first perforations uncovered, said slide valve including a first annular piston surface facing in a first axial direction of said first liner section and a second annular piston surface facing in said first axial direction, said second annular piston surface being outwardly of said first piston surface;

a spring operatively between said liner and said slide valve, said spring biasing said slide valve toward said first position;

an annular seal between said first piston surface and said second piston surface and between said liner and said slide valve when said slide valve is in said first position and separated from between said first piston surface and said second piston surface when said slide valve is displaced from said first position toward said second position;

tubing extending through said first liner section and defining an annular space between said tubing and said first liner section, said tubing including a valve inwardly of said first liner section having controlled valve passages extending from within said tubing to said annular space;

seals mounted on said tubing and extending outwardly of said tubing enclosing a portion of said annular space which portion is in communication with said first perforations.

5. The well tool of claim 4 further comprising:

a second liner section having second perforations through the wall thereof and being axially aligned and fixed to said first liner section, said tubing extending into said second liner section and defining a second annular space between said tubing and said second liner section, one of said seals being between said first perforations and said second perforations.

6. The well tool of claim 5, said tubing further including a second valve, said second valve being within said second liner section and having second controlled valve passages extending from within said tubing to said second space.

7. The well tool of claim 6 further comprising an under reamer axially aligned and fixed to said second liner section.

8. A well tool comprising:

a first liner section including a first wall and perforations through said first wall;

a second liner section including a second wall and perforations through said second wall and being axially aligned and fixed to said first liner section;

tubing extending through said first liner section and into said second liner section and defining an annular space between said tubing and said first and said second liner sections;

a seal between said first and said second liner sections in said annular space;

a first valve in said tubing inwardly of said first liner section having controlled valve passages extending from within said tubing to said annular space;

a second valve in said tubing inwardly of said second liner section having controlled valve passages extending from within said tubing to said annular space.

9. The well tool of claim 8 further comprising:

an under reamer axially aligned and fixed to said second liner section.

10. The well tool of claim 8 further comprising:

a slide valve movable in said first liner section from a first position with the perforations through said first wall covered to a second position with the perforations through said first wall uncovered.

11. A process for completing a zone in a well, comprising the steps of:

placing a liner with a section having valve controlled perforations in the well with the perforated section at the zone and the perforations closed;

placing a tube having an axial passageway and valve controlled radial passageways into the liner with the radial passageways in the perforated section so that there is an annular space between the tube and the liner;

axially sealing the annular space at each end of the perforated section;

closing the axial passageway of the tube below the perforated section;

opening the radial passageways through the tube at the perforated section;

opening the perforations;

circulating cement into the perforated section and through the perforations.

12. A process for completing first and second zones in a well, comprising the steps of:

placing a liner with a first section having valve controlled perforations and a second section having open perforations in the well with the first section at the first zone and the second section at the second zone and with the valve controlled perforations closed;

placing a tube having an axial passageway and first, valve controlled radial passageways and second radial passageways concentrically into the liner with the first radial passageways in the first section and the second radial passageways in the second section so that there is an annular space between the tube and the liner;

axially sealing the annular space at each end of the first section with seals;

establishing circulation down the well outwardly of the liner;

gravel packing the well at the second zone;

closing the axial passageway of the tube between the first section and the second section after said step of gravel packing;

opening the radial passageways through the tube at the first section;

opening the first, valve controlled perforations;

circulating cement into the first section and through the valve controlled perforations;

withdrawing the tube with the seals.

13. A process for completing first and second zones in a well, comprising the steps of:

placing a liner with a first section having valve controlled perforations and a second section having open perforations in the well with the first section at the first zone and the second section at the second zone and with the valve controlled perforations closed;

placing a tube having an axial passageway and first, valve controlled radial passageways and second radial passageways concentrically into the liner with the first radial passageways in the first section and the second radial passageways in the second section so that there is an annular space between the tube and the liner;

axially sealing the annular space at each end of the first section with seals;

establishing circulation down the well outwardly of the liner;

gravel packing the well at the second zone;

closing the axial passageway of the tube between the first section and the second section after said step of gravel packing;

establishing circulation down the tube;

opening the first radial passageways through the tube at the first section;

opening the first, valve controlled perforations;

circulating cement down the tube, into the first section and through the valve controlled perforations;

closing the first, valve controlled perforations;

establishing circulation down the tube;

raising the tube with the seals from the liner circulation is established down the tube.

14. A process for completing a well comprising the steps, of:

placing a length of perforated liner with an under reamer on the end thereof in a well;

placing a tube in the perforated liner so that there is an annular space between the tube and the length of perforated liner;

under reaming a first length of well;

under reaming a second length of well displaced downwardly from the first length of well;

opening a valve in the tube for circulation outwardly of the tube at the second length of well;

establishing circulation outwardly from the tube through the perforated liner to remove cuttings from the second length of well;

reversing the established circulation to outwardly of the liner at the second length of well;

adding gravel to the reversed circulation until circulation stops;

axially sealing the annular space above the second length of well;

opening another valve in the tube for circulation outwardly of the tube at the first length of well;

establishing circulation outwardly from the tube through the perforated liner to remove cuttings from the first length of well;

reversing the established circulation to outwardly of the liner at the first length of well;

adding gravel to the reversed circulation until circulation stops;

withdrawing the tube.

* * * * *

UNITED STATES PATENT AND TRADEMARK OFFICE

CERTIFICATE OF CORRECTION

PATENT NO. : 5,425,423

DATED : June 20, 1995

INVENTOR(S) : RICHARD M. DOBSON et al.

It is certified that error appears in the above-identified patent and that said Letters Patent is hereby corrected as shown below:

In claim 6 (col. 10, l. 20), before "space" insert -- annular --.

Signed and Sealed this

Twelfth Day of September, 1995

*Attest:*

Bruce Lehman

BRUCE LEHMAN

*Attesting Officer*

*Commissioner of Patents and Trademarks*